US006806762B2

(12) United States Patent
Stair et al.

(10) Patent No.: US 6,806,762 B2
(45) Date of Patent: Oct. 19, 2004

(54) CIRCUIT AND METHOD TO FACILITATE THRESHOLD VOLTAGE EXTRACTION AND FACILITATE OPERATION OF A CAPACITOR MULTIPLIER

(75) Inventors: Richard Kane Stair, Richardson, TX (US); Gabriel A. Rincon-Mora, Atlanta, GA (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/977,609

(22) Filed: Oct. 15, 2001

(65) Prior Publication Data

US 2003/0071675 A1 Apr. 17, 2003

(51) Int. Cl.[7] ..... G05F 1/10

(52) U.S. Cl. ..... 327/538; 327/356; 307/110; 323/313

(58) Field of Search ..... 327/538, 539–541, 327/543, 545, 546, 77, 78, 552, 536, 337, 390, 589; 307/109, 110, 35; 363/59–61; 323/312–317

(56) References Cited

U.S. PATENT DOCUMENTS

| | | | | |
|---|---|---|---|---|
| 3,911,296 A | * | 10/1975 | Davis | 327/552 |
| 5,095,223 A | * | 3/1992 | Thomas | 307/110 |
| 5,672,960 A | * | 9/1997 | Manaresi et al. | 323/313 |
| 5,952,874 A | | 9/1999 | Manaresi et al. | 327/541 |
| 6,084,475 A | | 7/2000 | Rincon-Mora | 330/255 |

OTHER PUBLICATIONS

X. Zhou, et al.; "Threshold Voltage Definition and Extraction for Deep–Submicron MOSFET's", *Solid–State Electronics*, Revised Oct. 17, 2000, p. 1–3.

A. Ortiz–Conde, et al.; "A New Approach to Extract the Threshold Voltage of MOSFET's", *IEEE Transactions on Electron Devices*, vol. 44, No. 9, Sep. 1997, p. 1523–1528.

G. Alfonso Rincon–Mora; "Active Capacitor Multiplier in Miller–Compensated Circuits", *IEEE*, 1999, p. 1–15.

C. Galup–Montoro, et al.; "MOSFET Threshold Extraction from Voltage–Only Measurements", *Electronics Letters*, vol. 30, No. 17, Aug. 18, 1994, p. 1458–1459.

N. Manaresi, et al.; "MOSFET Threshold Extraction Circuit", *Electronics Letters*, vol. 31, No. 17, Aug. 17, 1995, p. 1434–1435.

J. Ramirez–Angulo, et al.; "Low–Voltage CMOS Op–Amp with Rail–to–Rail Input and Output Signal Swing for Continuous–Time Signal Processing Using Multiple–Input Floating–Gate Transistors", *IEEE Transactions on Circuits and Systems*, vol. 48, No. 1, Jan. 2001, p. 111–116.

J. Ramirez–Angulo, et al.; "MITE Circuits: The Continuous–Time Counterpart to Switched–Capacitor Circuits", *IEEE Transactions on Circuits and Systems*, vol. 48, No. 1, Jan. 2001, p. 45–55.

L. Dobrescu, et al.; "Threshold Voltage Extraction Methods for MOS Transistors", *IEEE*, 2000, p. 371–374.

"Slew Rate Control of LVDS Circuits", *Application Report*, Texas Instruments Incorporated, Mar. 1999, p. 1–12.

* cited by examiner

*Primary Examiner*—Minh Nguyen
(74) *Attorney, Agent, or Firm*—W. Daniel Swayze, Jr.; W. James Brady; Frederick J. Telecky, Jr.

(57) ABSTRACT

A system and method to extract a threshold voltage for a MOSFET include first and second stages, which include inputs that receive functionally related input currents, are connected to each other. The first stage includes a second input that is coupled to a corresponding input of the second stage through part of a voltage divider. Another part of the voltage divider is coupled between an internal gate node and the input of the second stage that receives the respective input current. The input of the second stage that receives the respective input current also provides an output voltage substantially equal to the threshold voltage for one or both of the MOSFETs.

33 Claims, 6 Drawing Sheets

CIRCUIT AND METHOD TO FACILITATE THRESHOLD VOLTAGE EXTRACTION AND FACILITATE OPERATION OF A CAPACITOR MULTIPLIER

TECHNICAL FIELD

The present invention relates generally to operation of transistors and integrated circuits and, more particularly, to a system and method to facilitate extracting a threshold voltage of a MOSFET, which further can be employed to operate an associated circuit, such as capacitor multiplier.

BACKGROUND OF THE INVENTION

Metal Oxide Semiconductor Field Effect Transistors (MOSFETs) are often used to implement a variety of analog functions and digital logic, such as in the form of large scale integrated circuits (LSI) and very large scale integrated circuits (VLSI). A MOSFET can be controlled to provide various outputs as a function of its operating parameters. One important operating parameter is the threshold voltage $V_T$. The $V_T$ corresponds to a gate voltage that causes the onset of strong inversion in the channel of the MOSFET, allowing significant current flow through the device.

FIG. 1 illustrates a graphical representation of drain current $I_D$ plotted versus gate-source voltage $V_{GS}$, such as when the MOSFET operates in its linear region. The current-voltage characteristics can be divided into different regions, including a cut-off region 2, a weak inversion region 2, and a strong inversion region 6. Thus, a different level of inversion is provided for different gate-source voltages $V_{GS}$. A similar estimation-by-linear-extrapolation method can also be used for a MOSFET in the saturation region. Usually, this test is performed with the gate tied to the drain to ensure saturation, with the threshold voltage $V_T$ being extrapolated from a curve of $\sqrt{I_D}$ plotted versus $V_{GS}$.

Several approaches have been developed to determine the onset of strong inversion and, in turn, the $V_T$. One common approach is a constant current method in which the $V_T$ can be obtained with a single voltage measurement. The efficacy of this method generally depends on the selected current, as different drain currents tend to result in different threshold voltages. Another approach, often used by researchers, is a linear extrapolation method. In this method, a maximum transconductance is employed to locate a point of maximum slope along a plot of drain current versus gate-source voltage. However, the transconductance is dependent on the series resistance of the MOSFET, which can introduce errors.

Several other approaches have been developed to extract the threshold voltage and mitigate the dependency on the series resistance associated with the linear extrapolation method. One such approach is referred to as the second derivative method. In this method, the $V_T$ is calculated from the peak of the second derivative of drain current over gate-source voltage. This approach is sensitive to noise in the measurements as well as requires substantial processing to locate the peak of the second derivative. Other approaches to derive an indication of $V_T$ include a ratio method and a quasi-constant-current method, which have various limitations in addition to their complexities.

FIG. 2 illustrates an example of a capacitor multiplier circuit, which includes MOSFET devices MN1 and MN2 as an AC current mirror. The current mirror and capacitor C1 constitute an AC feedback loop, which tends to increase the effective capacitance seen at the output node by a factor of one plus N, where N is the ratio of aspect ratios (W/L) of MN1 to MN2. The effective increase in capacitance is due to a reduction in the current available to charge C1. When current $I_O$ in FIG. 2 charges the node $V_O$ during a transient condition, the current of the capacitor C1 is mirrored from MN2 to MN1, and amplified in the process by a factor of N. The gained current is pulled out of the output node $V_O$, reducing the current available to charge the capacitor C1. The feedback loop reduces the charging current, which has the substantially the same effect on the charge-up time as increasing the size of the capacitor.

For the feedback loop to function correctly, the voltage at the NMOS gates should be greater than or equal to the MOSFET threshold voltage, which permits the MOSFETs to conduct. Thus, with the capacitor multiplier circuit of FIG. 2, all of $I_0$'s current flows into the capacitor until the gate node of the current mirror reaches a voltage equal to $V_T$. The result is the initial transient behavior, such as shown in FIG. 3. In FIG. 3, the output voltage $V_O$ is plotted (in volts) versus time (in seconds), indicated at 10. The graph 10 illustrates the dV/dt characteristics of the capacitor multiplier of FIG. 2. The output voltage quickly ramps from 0V to $V_T$, at which point the current mirror begins to operate. The slew rate then decreases to the value determined by the feedback loop of C1. Theoretically, a capacitor multiplier should provide substantially linear dV/dt characteristics 10 without the initial charge-up to $V_T$, more closely resembling the charging of an ideal capacitor, also shown in FIG. 3 at 12.

SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

One aspect of the present invention provides a system for extracting the threshold voltage of a MOSFET. A first stage includes an input operative to receive a first input current. A gate node is electrically coupled to the first input. A second stage includes a gate node and an input operative to receive a second input current. A voltage divider or other network can be coupled between the input of the second stage and the gate node of the first stage, such that an intermediate node of the network is coupled to the gate node of the second stage. With proper biasing conditions and MOSFET sizing, the output voltage of the circuit is approximately equal to the threshold voltage for the MOSFET. In accordance with a particular aspect of the present invention, the output voltage from the voltage extraction system can be provided to a capacitor multiplier to mitigate startup offset usually associated with operation of the active capacitor multiplier, thereby improving the operation of the capacitor multiplier.

Another aspect of the present invention provides a substantially accurate capacitor multiplier system. The capacitor multiplier includes first and second stages coupled together at a common gate node. The first stage includes a first input that receives an input current and an ac feedback network, such as a capacitor, is coupled between an output of the second stage and the first input. A threshold voltage extraction system provides an output having a value functionally related to a threshold voltage for a MOSFET device associated with the second stage of the capacitor multiplier. The output from the threshold voltage extraction system is provided to a second input of the capacitor multiplier, such that the threshold voltage is provided to an common gate node of the capacitor multiplier so as to mitigate a startup offset of the capacitor multiplier circuit when the bias current is applied to the first input.

The following description and the annexed drawings set forth in certain illustrative aspects of the invention. These aspects are indicative, however, of but a few of the various ways in which the principles of the invention may be employed. Other advantages and novel features of the invention will become apparent from the following detailed description of the invention when considered in conjunction with the drawings.

DETAILED DESCRIPTION OF THE INVENTION

The present invention provides a system and method to extract a threshold voltage for a MOSFET. The system includes first and second stages driven by proportional input currents that are provided to first inputs of the respective stages. The first stage has another input coupled to a second input of second stage through part of a voltage divider. Another part of the voltage divider is coupled between an internal gate node and the input of the second stage that receives the respective input current. The input of the second stage that receives the respective input current also provides an output voltage substantially equal to the threshold voltage of the MOSFETs in the respective stages. An associated circuit, such as a capacitor multiplier, in turn, can utilize the output voltage.

Figure 4:
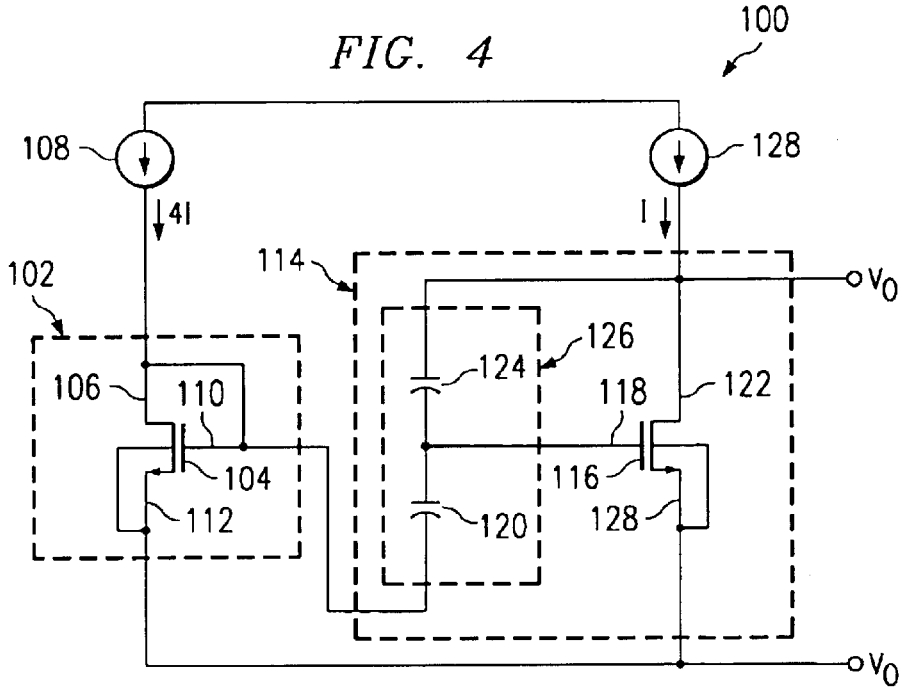
FIG. 4 is a schematic diagram of a voltage extraction circuit in accordance with an aspect of the present invention.

FIG. 4 illustrates an example of a voltage extraction circuit 100 in accordance with an aspect of the present invention. The circuit includes a first MOSFET stage 102 that includes a MOSFET 104 having a drain 106 that receives a predetermined input current from a current source 108. For example, a current mirror network driven by a reference current value could derive the current source 108. The drain 106 is electrically coupled (e.g., shorted) to a gate 110 of the MOSFET 104, with its source 112 being coupled to ground or another reference potential.

The stage 102 is coupled to another MOSFET stage 114. In accordance with an aspect of the present invention, the stage 114 includes a MOSFET 116 that is substantially similar to the MOSFET 104, such as having substantially the same channel length, although their respective channel widths can differ. For example, both MOSFETs 104 and 116 are floating gate NMOS transistors that have substantially identical threshold voltages. It is to be understood and appreciated that, alternatively, PMOS devices also could be used in place of the MOSFETs 104 and 116 for PMOS threshold voltage extraction in accordance with an aspect of the present invention.

The MOSFET 116 includes a gate 118 electrically coupled to the gate 110 of the first stage 102 through a capacitor 120. The gate 118 also is coupled to a drain 122 of the MOSFET 116 through another capacitor 124, such that the capacitors form a voltage divider network 126 between the drain 122 of the MOSFET 116 and the gate 110 of the MOSFET 104. A current source 128 provides an input current to the stage 114 and associated voltage divider. The input currents provided by the current sources 108 and 128 are proportional to each other. In accordance with a particular aspect of the present invention, the current source 108 provides an input current of 41 and the current source 128 provides an input current of I. For example, the current source 128 can include a transistor current mirror that derives the input current I based on the same reference current as the current source 108.

Those skilled in the art will understand and appreciate various techniques and arrangements that could be utilized to provide desired currents to the respective stages 102 and 114. It is further to be appreciated that the relationship between currents can further vary as a function of the MOSFETS 104 and 1116. For example, the currents provided from the sources 108 and 128 could be substantially equal with the devices being scaled with a ration of 4:1. Alternatively, the currents from the current sources 108 and 128 could have a ratio of 1:2, with the MOSFET devices scaled with a ratio of 2:1.

By way of illustration, the voltage $V_{g2}$ at the gate 118 of the MOSFET 116 can be expressed as:

$$V_{g2} = V_{g1}\frac{C1}{C1+C2} + V_{d2}\frac{C2}{C1+C2} \quad \text{where:} \qquad \text{(Eq. 1)}$$

$V_{g1}$=gate voltage of the MOSFET 104

$V_{d2}$=drain voltage of the MOSFET 116

C1=capacitance of the capacitor 120

C2=capacitance of the capacitor 124

According to one aspect of the present invention, the capacitance of the respective capacitors 120 and 124 are substantially equal. Thus, Eq. 1 reduces to:

$$V_{g2} = \frac{1}{2}(V_{g1} + V_{d2}) \qquad \text{(Eq. 2)}$$

To help prevent parasitic effects from altering Eq. 1, the capacitances of the respective capacitors 120 and 124 further should be significantly greater than the parasitic gate capacitance of the MOSFETs 104 and 116.

Also, if the MOSFET 116 operates in its saturation region, standard MOSFET equations apply, such that the gate voltage $V_{g2}$ can be expressed as:

$$V_{g2} = V_T + \sqrt{\frac{2I_D}{\beta}} \quad \text{(Eq. 3)}$$

where:

$V_T$=threshold voltage of the MOSFET 116, $I_D$=drain current of the MOSFET 116, and $\beta=\mu_o{}^*C_{OX}{}^*W/L$, where $\mu_o$ is the mobility of the electrons in the induced n channel and $C_{OX}$ is the capacitance per unit area of the gate-to-channel capacitor for which the oxide layer serves as a dielectric.

By way of further illustration, assume that the current source 108 sources the current 41 into the MOSFET 104, while the current source 128 sources I into the MOSFET 116. Because the gate 110 of the MOSFET 104 is tied to its drain 106, the transistor is saturated and the voltage $V_{g1}$ at its gate 110 is equal to:

$$V_{g1} = V_T + \sqrt{\frac{8I}{\beta}}. \quad \text{(Eq. 4)}$$

Assuming that the MOSFET 116 also is saturated, $V_{g2}$ and $V_{g1}$ can be substituted into Equation 2 to solve for the voltage $V_{d2}$ at the drain of MN2, as follows:

$$V_{g2} = V_T + \sqrt{\frac{2I}{\beta}} = \frac{1}{2}\left(V_T + \sqrt{\frac{8I}{\beta}}\right) + \frac{V_{d2}}{2}, \quad \text{(Eq. 5)}$$

When written in terms of $V_{d2}$, which corresponds to the output voltage $V_O$ of the circuit 100, Eq. 5 becomes:

$$V_{d2} = 2\left(V_T + \sqrt{\frac{2I}{\beta}}\right) - \left(V_T + \sqrt{\frac{8I}{\beta}}\right), \quad \text{(Eq. 6)}$$

which further simplifies to:

$$V_{d2}=V_T. \quad \text{(Eq. 7)}$$

Hence, provided that $$\sqrt{\frac{2I}{\beta}}$$

does not exceed $V_T$ (e.g., $V_{DS}>V_{GS}-V_T$), the MOSFET 116 will be in the saturation region, and all equations will apply. In addition, early voltage mismatch is relatively small, because the voltages on the drains 106 and 122 of the transistors 104 and 116 differ by only about $$\sqrt{\frac{8I}{\beta}}.$$

Figure 5:
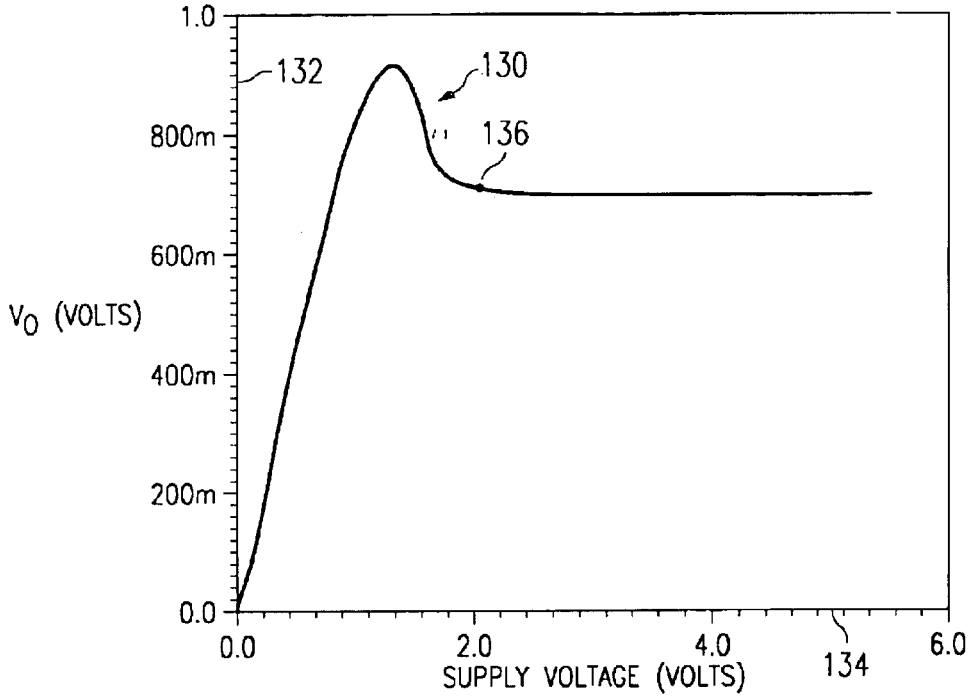
FIG. 5 is a graph depicting an output voltage versus input supply voltage for a threshold voltage extraction circuit in accordance with an aspect of the present invention.

FIG. 5 is a graph 130 in which the output voltage $V_O$ of the circuit 100 of FIG. 4 is plotted (in volts) on a Y-axis 132 versus a supply voltage (in volts) on the X-axis 134. The graph illustrates that the output voltage $V_O$ at the drain of the threshold voltage extraction circuit 100 (FIG. 4) is independent of the supply voltage above a minimum supply voltage, indicated at 136. In the example of FIG. 4, the minimum supply voltage to drive the circuit 100 is about 2.0 volts. It is to be appreciated that the minimum supply voltage generally will vary according to the device characteristics, and to the particular circuit arrangement utilized to provide a threshold voltage extraction circuit in accordance with an aspect of the present invention.

Figure 6:
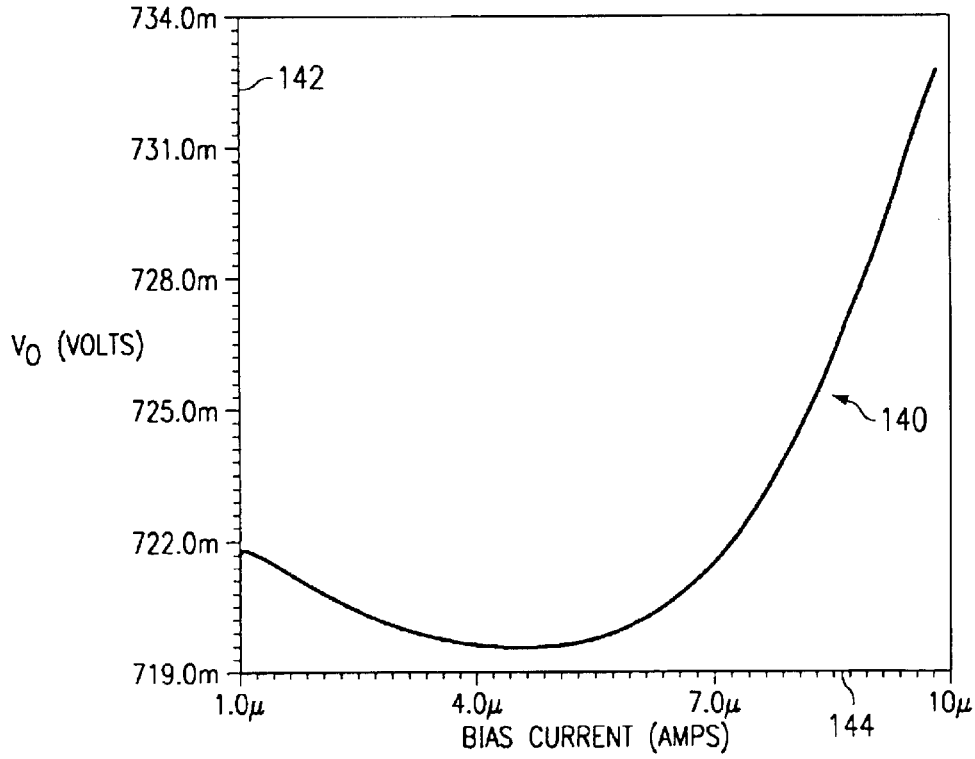
FIG. 6 is a graph depicting an output voltage versus bias current for a threshold voltage extraction circuit in accordance with an aspect of the present invention.

FIG. 6 is a graph 140 in which the output voltage $V_O$ at 122 of the circuit of FIG. 4 is plotted (in volts) on a Y-axis 142 versus the bias current (in Amps), which corresponds to the current I in FIG. 4, on an X-axis 144. The graph 140 shows that, so long as the transistors 104 and 116 remain saturated, the output voltage is substantially independent of the bias current. For example, the output voltage shown in FIG. 6 varies by only about 2% relative to the bias current while the MOSFET 116 is saturated.

Figure 7:
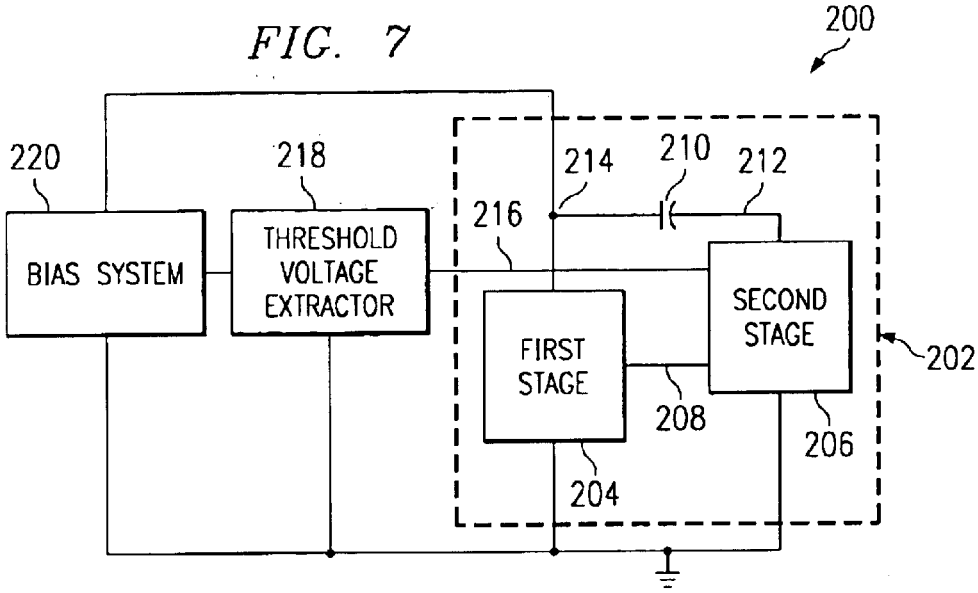
FIG. 7 is a schematic block diagram of a capacitor multiplier system in accordance with an aspect of the present invention.

FIG. 7 illustrates an example of a capacitor multiplier system 200 configured for operation in accordance with an aspect of the present invention. The system 200 includes a capacitor multiplier 202, which generally includes two stages 204 and 206 coupled together by a connection 208. Each of the stages 204, 206, for example, includes a floating gate NMOS (or PMOS) transistor, with the connection coupling their respective gates together. A feedback capacitor 210 is coupled between an output 212 of the second stage 206 and an input 214 to the first stage 204. The capacitor 210 operates to augment the effective capacitance of the multiplier seen at an output 214 of the capacitor multiplier 202.

The capacitor multiplier 202 receives a predetermined input voltage at an input 216, which voltage is proportional (or equal) to the threshold voltage of a MOSFET associated with the second stage 206. In the example of FIG. 7, the input signal provided at 216 is provided by a threshold voltage extraction system 218. The threshold voltage extraction system 218 can include an arrangement of components similar to that shown and described with respect to FIG. 4. Alternatively, the threshold voltage extraction system 218 can be implemented in other ways, including, for example, hardware and/or software programmed and/or configured to implement a linear extrapolation method, a constant current method, a second derivative method, a ratio method, a quasi-constant current method, or the like.

Figure 1:
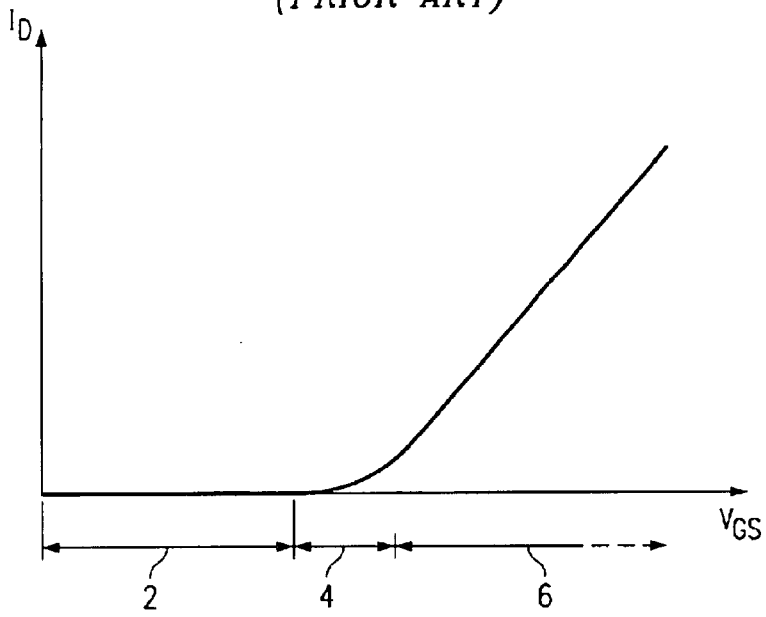
FIG. 1 (PRIOR ART)
FIG. 1 is a graph depicting drain current versus gate-source voltage for a MOSFET operating in its linear region.
Figure 2:
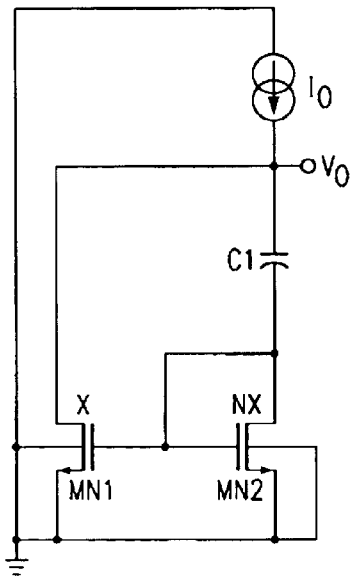
FIG. 2 (PRIOR ART)
FIG. 2 is an example of a capacitor multiplier circuit.
Figure 3:
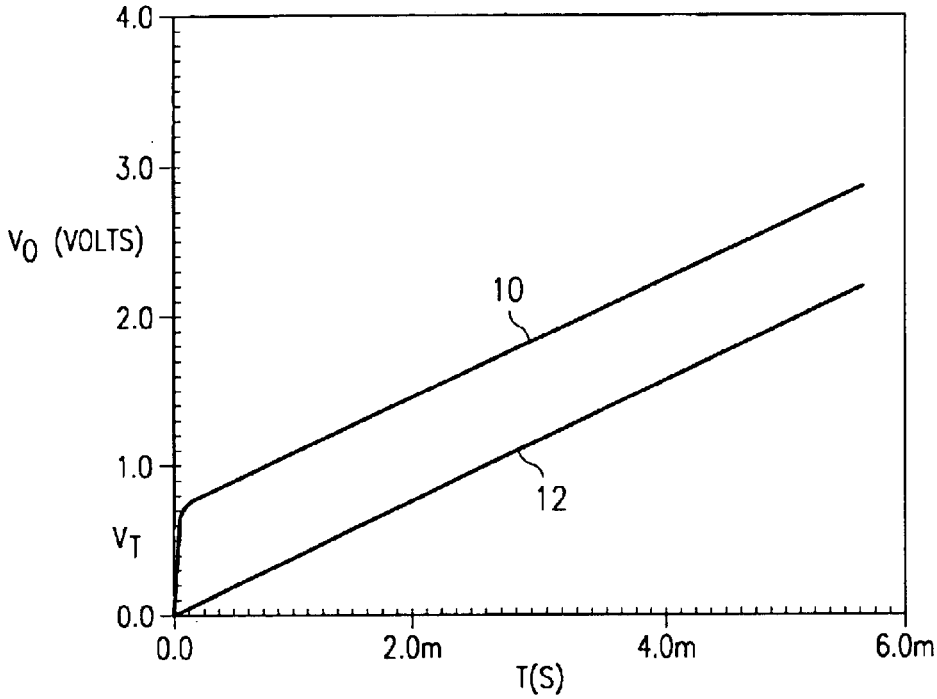
FIG. 3 (PRIOR ART)
FIG. 3 is a graph depicting voltage versus time, illustrating an ideal capacitor and the output of the capacitor multiplier of FIG. 2.

The threshold voltage extraction system 218 provides an output voltage to the input 216 of the capacitor multiplier 202, such that a resulting voltage at the connection 208 between the stages 204 and 206 is about greater than or equal to the threshold voltage of the MOSFET(s) that form the second stage. By way of illustration, the second stage includes voltage divider coupled to the input 216 and receives the output voltage from the threshold voltage extractor 218, such as an integer multiple of the threshold voltage (e.g., $2V_T$). The voltage divider causes a desired voltage drop in the voltage at 216 SO that the threshold voltage is provided to the connection 208 coupled between respective gates of the MOSFETs in the capacitor multiplier. Because at least the threshold voltage is provided to the respective gates of the stages 204 and 206, a start up offset voltage, such as shown in FIG. 3, is mitigated.

A bias system 220 is electrically coupled to provide input currents to the voltage extraction system 218 and to the capacitor multiplier 202 at 214. For example, the bias system can include a power supply that energizes one or more current sources configured to provide desired current to the respective threshold voltage extractor 218 and capacitor multiplier 202.

It is to be understood and appreciated that the capacitor multiplier 202 can be implemented as a voltage-mode capacitor multiplier or a current-mode capacitor multiplier. By way of example, the capacitor multiplier can be arranged in accordance with the teachings of U.S. Pat. No. 6,084,475, which is incorporated herein by reference, although other types and arrangements of capacitor multipliers also could be employed in accordance with an aspect of the present invention.

Figure 8:
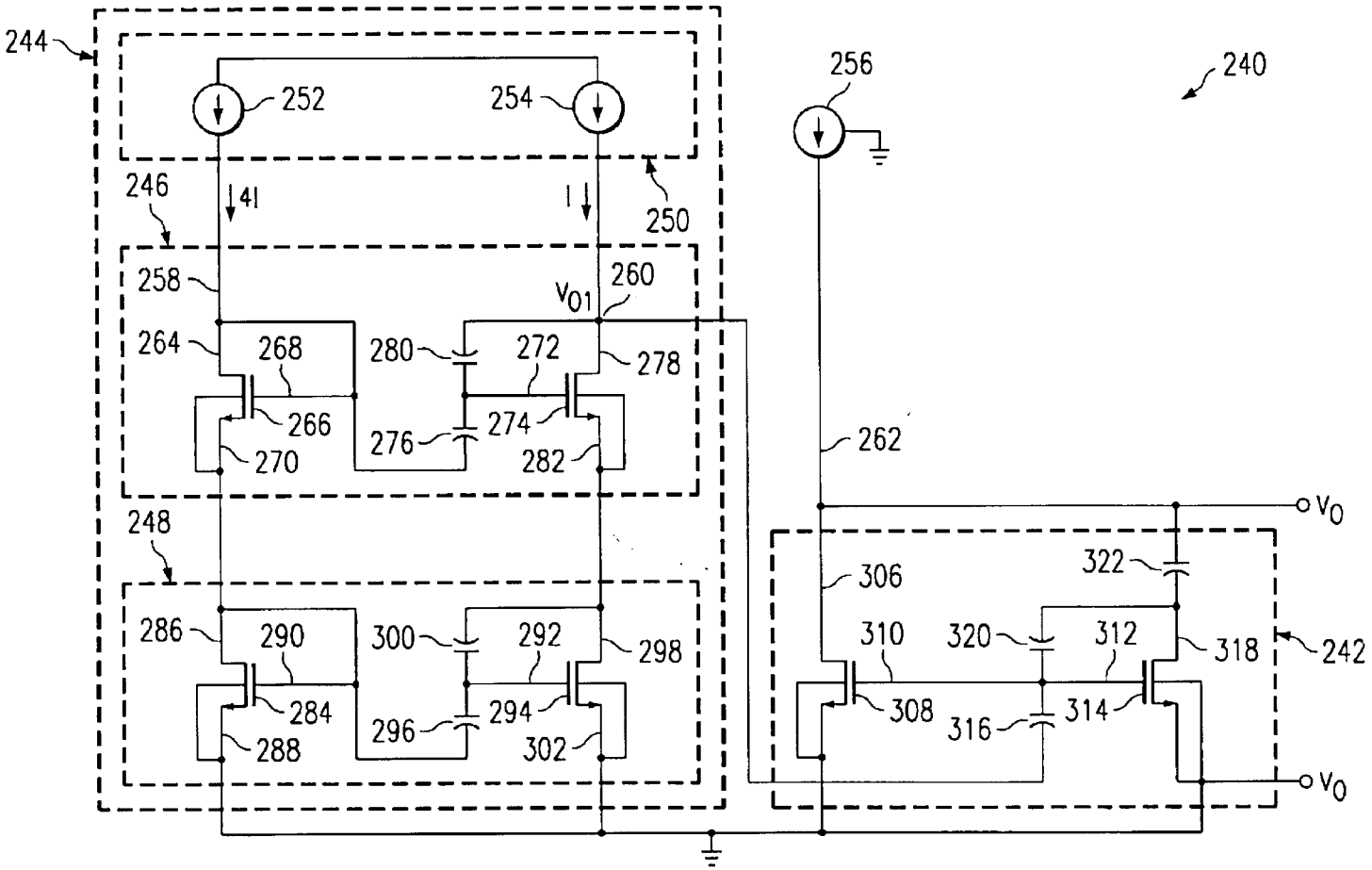
FIG. 8 is an example of capacitor multiplier circuit in combination with a threshold voltage extraction circuit in accordance with an aspect of the present invention.

FIG. 8 illustrates another example of a capacitor multiplier system 240 in accordance with an aspect of the present invention. The system 240 in this example includes a capacitor multiplier system 242 that is coupled to a threshold voltage extraction system 244. The threshold voltage extraction system includes a pair of stacked voltage threshold extractors 246 and 248 and a power supply system 250 configured to energize the stacked extractors.

By way of example, the power supply system 250 includes a plurality of current sources 252 and 254 that provide current signals respectively to inputs 258 and 260 of the voltage extraction system 244. In one aspect of the present invention, the currents are proportional to each other. For example, the current signals provided to input 258 can be substantially equal to four times the current provided to the input 260. Those skilled in the art will understand and appreciate various circuit arrangements (e.g., an arrangement of PMOS current mirrors that follow a desired reference current) that could be employed to provide desired current levels to the respective inputs 258 and 260.

Another current source 256 is configured to provide a current signal to an input 262 of the capacitor multiplier 242. The current source 256 can provide any desired level of current to the capacitor multiplier 242, which further may be independent of the current provided by sources 252 and 254. It is to be appreciated that to reduce the real estate used to implement the circuit arrangement of FIG. 8, the current sources 252, 254 and 256 can be operative associated with a common voltage source and configured to provide desired current signals, as described herein.

As mentioned above, the first voltage extractor 246 is arranged to receive respective currents from the current sources 252 and 254, which currents can be proportional to each other. The current from the source 252 is provided to the input 258, which is coupled to a drain 264 of an n-type MOSFET 266. The drain 264 is electrically coupled to a gate 268. A source 270 of the MOSFET 266 is coupled to an input of the second voltage extractor 248. The gate 268 is coupled to a gate 272 of a second MOSFET 274 through a capacitor 276. The gate 272 is coupled to a drain 278 of the MOSFET 274 through another capacitor 280. The capacitors 276 and 280, for example, have approximately equal capacitances and form a voltage divider network between the gate 268 of the MOSFET 266 and the drain 278 of the MOSFET 274. A source 282 of the MOSFET 274 provides a second input the second voltage extractor 248. The drain 278 corresponds to the input 260 of the first voltage extractor 246, as well as provides a desired output $V_O$ from the voltage extraction system 244 to the capacitor multiplier 242.

The second voltage extractor 248 is substantially identical to the first voltage extractor 246. Briefly stated, a MOSFET 284 includes a drain 286 coupled to the source 270 of the MOSFET 266 and a source 288 coupled to ground potential. The drain 286 further is coupled to a gate 290 of the MOSFET 284. The gate 290 is coupled to a gate 292 of second MOSFET 294 through a capacitor 296. The gate 292 is coupled to a drain 298 through another capacitor 300, such that the capacitors 296 and 300 form a voltage divider having an internal node at the gate 292. A source 302 of the MOFET 294 is coupled to ground potential.

Because of the configuration of each of the voltage extractors 246 and 248 and the currents provided at the inputs 258 and 260, each of the extractors is operative to provide a voltage at the drain of its second stage equal to the threshold voltage of the respective MOSFETS 266, 274, 284, and 294 being employed. Further, because the voltage extractors 246 and 248 are stacked in a series configuration, an output voltage $V_{O1}$ at node 260 is the sum of the two threshold voltages (e.g., $2V_T$).

As mentioned above, the voltage extraction system 244 provides the output voltage $V_{O1}$ to one input to the capacitor multiplier 242. The input 262 is coupled to a first stage of the capacitor multiplier and the output 260 is coupled to a second stage of the capacitor multiplier. In particular, the input 262 is coupled to a drain 306 of a MOSFET 308. The MOSFET 308 further includes a source coupled to ground potential and a gate 310 coupled to a gate 312 of a MOSFET 314 of the second stage of the capacitor multiplier 242. The output 260 of the threshold voltage extraction system is coupled to the gate 312 through a capacitor 316. The gate 312 further is coupled to a drain 318 through another capacitor 320. The capacitor multiplier 242 also includes a feedback capacitor 322 coupled between the drain 318 of the second MOSFET 314 and the drain 306 of the first MOSFET 306.

In accordance with an aspect of the present invention, the capacitors 316 and 320 form a voltage divider having an intermediate node at the respective gates 310 and 312. It is to be appreciated that any ratio of capacitances could be used to provide a desired voltage at 312 relative to the respective voltages at 260 and 318. For example, the capacitors can be selected to have substantially equal capacitances. Accordingly, when the voltage $V_{O1}$ at the output 260 of the voltage extraction system 244 is equal to about $2V_T$ and the voltage at 318 is equal to zero, the gate voltage at 310 and 312 is equal to about $V_T$ due to the voltage drop across the respective capacitors 316 and 320. As result, an offset voltage generally equal to about $V_T$ that tends to occur in a capacitor multiplier is mitigated. This helps improve performance and accuracy of the capacitor multiplier so as to better simulate an ideal capacitor.

Figure 9:
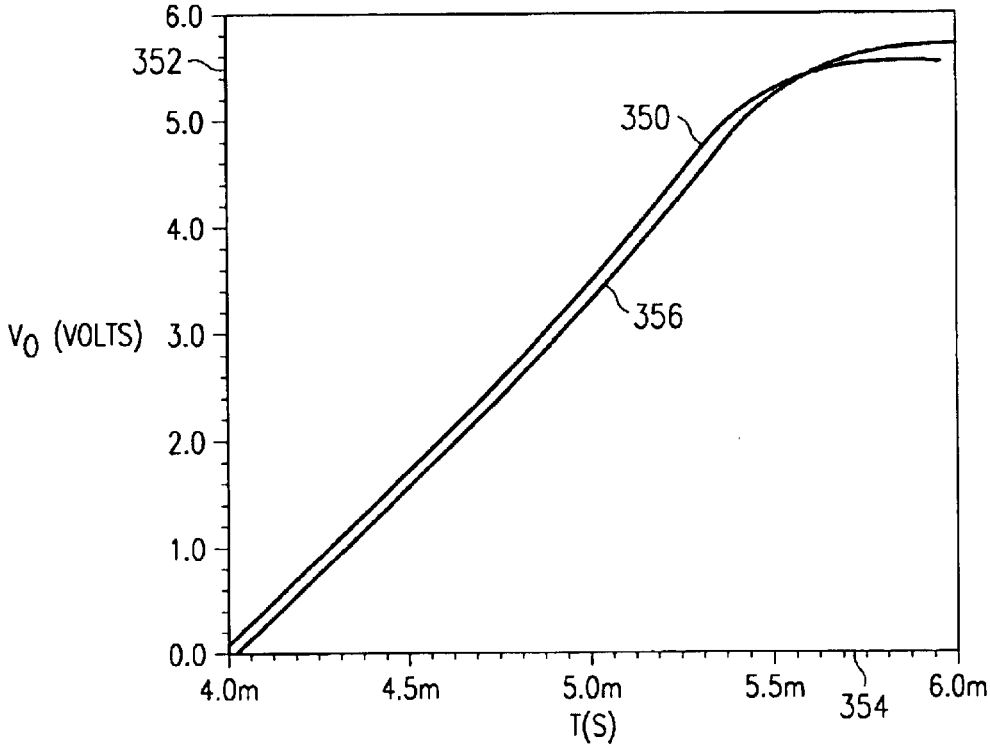
FIG. 9 is a graph depicting voltage versus time for an ideal capacitor and an output of a capacitor multiplier in accordance with an aspect of the present invention.

FIG. 9 illustrates an example of a graph 350 in which an output voltage $V_O$ is plotted (in volts) on a Y-axis 352 and time is plotted (in seconds) on an X-axis 354. Thus, the graph 350 illustrates change in output voltage $V_O$ versus time, namely, dV/dt characteristics for the capacitor multiplier system 240 shown in FIG. 8. Another graph 356 illustrates the dV/dt characteristics for a similarly configured, but much larger ideal capacitor. It is to be appreciated that most of the offset, which is equal to about the threshold voltage of the MOSFET in the output stage associated with a conventional capacitor multiplier has been eliminated because of the voltage applied from the threshold voltage extraction system 244. A small startup offset, however, may still exist in the system 240. The effects of the small offset further can be mitigated, such as by increasing the size of the output stage MOSFET (e.g., making its W/L larger). Those skilled in the art will understand and appreciate other techniques that could be employed to further reduce the small remaining startup offset.

Figure 10:
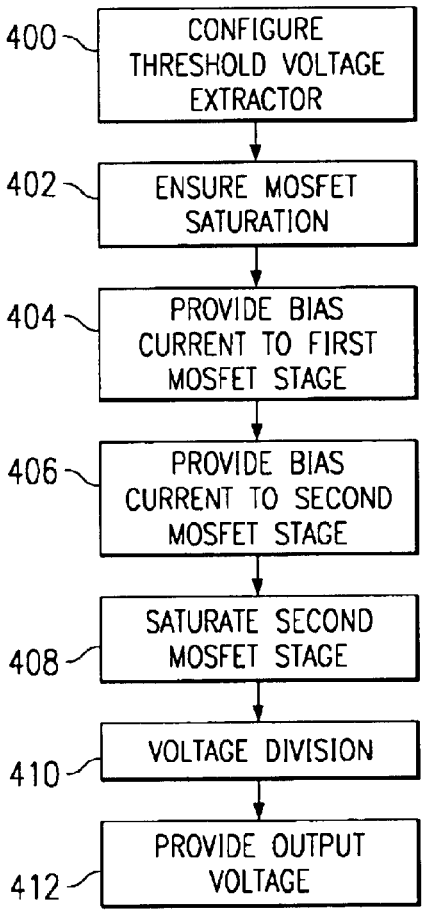
FIG. 10 is a flow diagram illustrating a methodology for extracting a threshold voltage in accordance with an aspect of the present invention.
Figure 11:
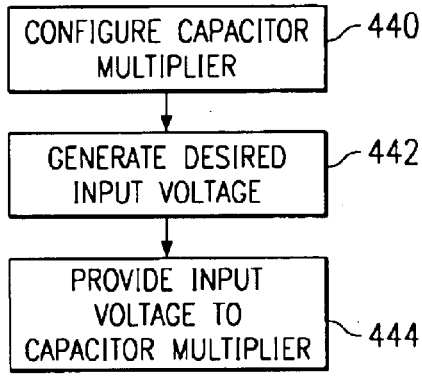
FIG. 11 is a flow diagram illustrating a methodology for improved operation of a capacitor multiplier in accordance with an aspect of the present invention.

In view of the foregoing structural and functional features described above, a methodology in accordance with various aspects of the present invention will be better appreciated with reference to FIGS. 10 and 11. While, for purposes of simplicity of explanation, the methodologies of FIGS. 10 and 11 are shown and described as executing serially, it is to be understood and appreciated that the present invention is not limited by the illustrated order, as some aspects could, in accordance with the present invention, occur in different orders and/or concurrently with other aspects from that shown and described herein. Moreover, not all illustrated features may be required to implement a methodology in accordance with an aspect the present invention. It is to be understood that the following methodologies can be implemented in hardware, integrated circuits, software, or a combination thereof.

FIG. 10 illustrates a methodology implemented by a voltage extraction system in accordance with an aspect of the present invention. The methodology begins at 400 by configuring the system to include first and second MOSFET stages, such that each stage includes substantially identical floating gate n-type MOSFETs (e.g., having approximately the same aspect ratio). The respective gates of the MOSFETs are electrically coupled to each other through part of a voltage divider, which is operative to provide a desired voltage drop (e.g., about ½) between the gate of the first MOSFET and the gate of the second MOSFET.

At 402, the first MOSFET stage is forced to operate in saturation, such as by coupling its gate to its drain. At 404, bias current is provided to an input of the first stage, such as to the drain of the first stage MOSFET. At 406, a bias current also is provided to an input of the second stage MOSFET. In accordance with an aspect of the present invention, the bias currents at 404 and 406 are proportional. For example, the current provided to the first stage is four times the input current provided to the second stage. The second stage MOSFET also operates in its saturation region at 408.

At 410, voltage division occurs between the drain of the second stage and the gate of the first stage. An output voltage is provided (412) at the drain of the second stage, which is substantially equal (or integrally proportional, e.g., 1×, 2×, 3×, etc.) to the threshold voltage $V_T$ of the second stage MOSFET provided that the MOSFETs are saturated and the proportional currents are provided at 404 and 406. The output voltage can be utilized by any system or circuit requiring an indication of a threshold voltage for a given MOSFET device that is substantially identical to the MOSFET devices utilized to perform the threshold voltage extraction.

By way of particular illustration, FIG. 11 illustrates a methodology for implementing an accurate capacitor multiplier that exhibits improved performance by mitigating startup offset associated with its operation. The methodology begins at 440 by providing a capacitor multiplier circuit, such as a current-mode or voltage-mode capacitor multiplier. It is to be understood and appreciated by those skilled in the art that any capacitor multiplier network could be utilized, including a Miller-compensated amplifier configured according to the above-incorporated U.S. Pat. No. 6,084,475. The capacitor multiplier generally includes two MOSFET stages coupled together with a feedback capacitor coupled between the output of the second stage and an input of the first stage. For example, gates of the respective MOSFET stages could be coupled together, such that when the output voltage reaches the threshold voltage the system provides a current mirror.

At 442, a voltage substantially equal (or proportional) to the threshold voltage of the second stage MOSFET is generated by an associated system. The threshold voltage, for example, can be generated by a voltage extraction system, as described herein. Alternatively, other known means can be provided to generate a voltage equal (or proportional) to the threshold voltage. Examples of alternative approaches that can be utilized to provide an indication of threshold voltage, in accordance with an aspect of the present invention, include: a linear extrapolation method, a constant current method, a second derivative method, a ratio method, a quasi-constant current method, and the like.

At 444, the generated indication of threshold voltage is provided as an input voltage to the capacitor multiplier. For example, the application of the voltage to the capacitor multiplier results in the threshold voltage for the second stage MOSFET being applied to its gate. Advantageously, by applying a voltage substantially equal to the threshold voltage to the gates of the current mirror before the output node beings to charge up, startup offset is mitigated. Additionally, the threshold voltage $V_T$ enables the dV/dt characteristics of the capacitor multiplier to more closely resemble an ideal capacitor. In the absence of applying the input voltage to the capacitor multiplier, in accordance with an aspect of the present invention, a startup offset tends to occur as the feedback capacitor charges from 0 V to $V_T$.

What has been described above includes exemplary implementations of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A system for extracting a threshold voltage, comprising:

a first MOSFET stage including an input operative to receive a first input current, and a gate node electrically coupled to the input thereof;

a second MOSFET stage including an input operative to receive a second input current and a gate node; and a voltage divider coupled between the input of the second MOSFET stage and the gate node of the first MOSFET stage, the voltage divider also having an intermediate output node coupled to the gate node of the second MOSFET stage, such that an output voltage at the input of the second MOSFET stage is approximately equal to the threshold voltage for at least one of the first and second MOSFET stages.

2. The system of claim 1, the first MOSFET stage further comprising a floating gate MOSFET having a drain that defines the input of the first MOSFET stage and a gate that defines the gate node of the first MOSFET stage, the floating gate MOSFET of the first MOSFET stage operating in a saturation region thereof.

3. The system of claim 2, the second MOSFET stage further comprising a floating gate MOSFET having a drain that defines the input of the second MOSFET stage and a gate that defines the gate node of the second MOSFET stage, the floating gate MOSFET of the second MOSFET stage operating in a saturation region thereof.

4. The system of claim 3, the first and second input currents being proportional to each other.

5. The system of claim 4, the first input current being approximately four times the second input current.

6. The system of claim 4, the first input current and the second input current being functionally related to each other according to the scaling of the respective MOSFETs of the first and second MOSFET stages.

7. The system of claim 3, each of the first and second MOSFETs further comprising a respective NMOS transistor.

8. The system of claim 3, each of the first and second MOSFETs further comprising a respective NMOS transistor.

9. The system of claim 1, the voltage divider further comprising a first capacitor connected with a second capacitor in series between the input of the second MOSFET stage and the gate node of the first MOSFET stage, a node between the first and second capacitors defining the intermediate output node that has a voltage functionally related to capacitances of the first and second capacitors.

10. The system of claim 9, the first capacitor having a capacitance substantially equal to the second capacitor.

11. The system of claim 9, the first and second capacitors having respective capacitances that are greater than parasitic gate capacitance associated with the second MOSFET stage.

12. A system, comprising:

a first system comprising:

a first MOSFET stage including an input operative to receive a first input current, and a gate node electrically coupled to the input thereof;

a second MOSFET stage including an input operative to receive a second input current and a gate node;

a voltage divider coupled between the input of the second MOSFET stage and the gate node of the first MOSFET stage, the voltage divider also having an intermediate output node coupled to the gate node of the second MOSFET stage, such that an output voltage at the input of the second MOSFET stage is approximately equal to the threshold voltage for at least one of the first and second MOSFET stages; and a second system for extracting a threshold voltage coupled to the first system for extracting a threshold voltage to provide a stacked threshold voltage extraction system having an output that is an integer multiple of the threshold voltage of the second system.

13. A system, comprising:

a first MOSFET stage including an input operative to receive a first input current, and a gate node electrically coupled to the input thereof;

a second MOSFET stage including an input operative to receive a second input current and a gate node;

a voltage divider coupled between the input of the second MOSFET stage and the gate node of the first MOSFET stage, the voltage divider also having an intermediate output node coupled to the gate node of the second MOSFET stage, such that an output voltage at the input of the second MOSFET stage is approximately equal to the threshold voltage for at least one of the first and second MOSFET stages; and a capacitor multiplier including a first input that receives the output voltage at the input of the second MOSFET stage and a second input that receives a bias current, such that a startup offset for the capacitor multiplier is mitigated when the bias current is applied to the second input.

14. The system of claim 13, the capacitor multiplier further comprising:

first and second stages coupled together at a common node, the first input of the capacitor multiplier being associated with the common node so that a voltage approximately equal to the threshold voltage is at the common node; and a feedback capacitor coupled between an output of the capacitor multiplier and the second input of the capacitor multiplier.

15. The system of claim 14, the first input current and the second input current having values proportional to each other.

16. A system for extracting a threshold voltage, comprising:

a first MOSFET having a drain connected to receive a first input current, a gate electrically coupled to the drain, and a source coupled to a reference potential;

a second MOSFET having a gate, source and drain, the drain being connected to receive a second input current, the source being coupled to the reference potential;

a first part of a voltage divider being coupled between the gate of the first MOSFET and the gate of the second MOSFET;

a second part of the voltage divider being coupled between the gate and the drain of the second MOSFET, such that an output voltage at drain of the second MOSFET is approximately equal to the threshold voltage for at least one of the first and second MOSFETs.

17. The system of claim 16, the first and second input currents being proportional to each other.

18. The system of claim 17, the first input current being approximately four times the second input current.

19. The system of claim 16, the first and second input currents being functionally related to each other according to the scaling of the respective first and second MOSFETs.

20. The system of claim 16, the first and second parts of the voltage divider comprising first and second capacitors respectively.

21. The system of claim 20, the first capacitor having a capacitance substantially equal to that of the second capacitor.

22. The system of claim 21, the first and second capacitors having respective capacitances that are greater than a parasitic gate capacitance associated with the second MOSFET.

23. The system of claim 16, each of the first and second MOSFETs being a respective PMOS transistor.

24. The system of claim 16, each of the first and second MOSFETs being a respective NMOS transistor.

25. A system, comprising:

a first system comprising:

a first MOSFET having a drain connected to receive a first input current, a gate electrically coupled to the drain, and a source coupled to a reference potential;

a second MOSFET having a gate, source and drain, the drain being connected to receive a second input current, the source being coupled to the reference potential;

a first part of a voltage divider being coupled between the gate of the first MOSFET and the gate of the second MOSFET;

a second part of the voltage divider being coupled between the gate and the drain of the second MOSFET, such that an output voltage at drain of the second MOSFET is approximately equal to the threshold voltage for at least one of the first and second MOSFETs; and a second system for extracting a threshold voltage coupled to the first system for extracting a threshold voltage to provide a stacked threshold voltage extraction system having an output that approximates an integer multiple of the threshold voltage of the second system.

26. A system, comprising:

a first MOSFET having a drain connected to receive a first input current, a gate electrically coupled to the drain, and a source coupled to a reference potential;

a second MOSFET having a gate, source and drain, the drain being connected to receive a second input current, the source being coupled to the reference potential;

a first part of a voltage divider being coupled between the gate of the first MOSFET and the gate of the second MOSFET;

a second part of the voltage divider being coupled between the gate and the drain of the second MOSFET, such that an output voltage at drain of the second MOSFET is approximately equal to the threshold voltage for at least one of the first and second MOSFETs;

a capacitor multiplier circuit comprising first and second amplifier stages coupled together at a common node, the first stage having a first input that receives a bias current; and the output voltage from the drain of the second MOSFET being applied to the capacitor multiplier circuit so that voltage approximately equal to the threshold voltage is at the common node, such that a startup offset for the capacitor multiplier circuit is mitigated as the bias current is applied to the first input of the capacitor multiplier circuit.

27. A capacitor multiplier system, comprising:

a threshold voltage extraction system that provides an output having a value functionally related to a threshold voltage; and a capacitor multiplier circuit comprising a first and second stages coupled together at a common gate node, the first stage having a first input that receives an input current, a feedback capacitor being coupled between an output of the second stage of the capacitor multiplier circuit and the first input, the output from the threshold voltage extraction system being provided to a second input of the capacitor multiplier circuit that is operatively connected with the common gate node, such that the threshold voltage is provided to at the common gate node and a startup offset for the capacitor multiplier circuit is mitigated as the input current is applied to the first input.

28. The system of claim 27, the voltage extraction system further comprising a first MOSFET stage coupled to a second MOSFET stage, the first MOSFET stage operative to receive a first input current, the second MOSFET stage having an input operative to receive a second input current, which is proportional to the first input current, the input of the second MOSFET stage defining the output of the voltage extraction.

29. The system of claim 28, further comprising a voltage divider coupled between the input of the second MOSFET stage and a gate node of the first MOSFET stage, the voltage divider also having an intermediate output node coupled to a gate node of the second MOSFET stage, such that a voltage at the input of the second MOSFET stage is approximately equal to a threshold voltage for at least one of the first and second MOSFET stages of the voltage extraction system.

30. The system of claim 27, the voltage extraction system further comprising a plurality of stacked voltage extractors coupled in series so that the output of the voltage extraction system is approximately n times the threshold voltage, where n is an integer greater than zero.

31. A method for extracting a threshold voltage for a MOSFET device having a gate, source and drain, the method comprising:

connecting gates of first and second stages through a first part of a voltage divider, each stage including a respective MOSFET device;

saturating the MOSFET device of the first stage;

providing bias current to an input of the first stage;

providing bias current to an input of the second stage, the input of the second stage being connected to the gate of the second stage through a second part of the voltage divider;

saturating the MOSFET device of the second stage, such that a voltage at the input of the second stage corresponds to the threshold voltage.

32. The method of claim 31, the bias current to the input of the first stage being proportional to the bias current to the input of the second stage.

33. A method for employing a MOSFET device having a gate, source and drain, the method comprising:

connecting gates of first and second stages through a first part of a voltage divider, each stage including a respective MOSFET device;

saturating the MOSFET device of the first stage;

providing bias current to an input of the first stage;

providing bias current to an input of the second stage, the input of the second stage being connected to the gate of the second stage through a second part of the voltage divider;

saturating the MOSFET device of the second stage, such that a voltage at the input of the second stage corresponds to the threshold voltage;

wherein the bias current to the input of the first stage is proportional to the bias current to the input of the second stage; and providing the voltage at the output of the second stage to an input of a capacitor multiplier, such that the threshold voltage is applied to an internal node of the capacitor multiplier and a startup offset of the capacitor multiplier is mitigated.

* * * * *